United States Patent [19]

Avaiusini

[11] 4,236,395

[45] Dec. 2, 1980

[54] BOLT TYPE LOCK

[76] Inventor: Mauricio V. Avaiusini, 2031 S. 331st, Federal Way, Wash. 98003

[21] Appl. No.: 17,366

[22] Filed: Mar. 5, 1979

[51] Int. Cl.[3] ..... E05B 67/36

[52] U.S. Cl. ..... 70/34; 70/19

[58] Field of Search ..... 70/32, 33, 34, 19, 360, 70/23

[56] References Cited

U.S. PATENT DOCUMENTS

| | | | |
|---|---|---|---|
| 1,617,204 | 2/1927 | Errecalde | 70/34 |
| 2,018,745 | 10/1935 | Schlitz | 70/34 |
| 2,492,381 | 12/1949 | Reichert | 70/32 |
| 2,660,872 | 12/1953 | Beach | 70/32 |
| 3,995,459 | 12/1976 | Weeks | 70/13 |
| 4,026,132 | 5/1977 | Best | 70/9 |
| 4,031,720 | 6/1977 | Avaiusini | 70/58 |
| 4,057,984 | 11/1977 | Avaiusini | 70/58 |
| 4,111,015 | 9/1978 | Look | 70/58 |

*Primary Examiner*—Robert L. Wolfe
*Attorney, Agent, or Firm*—Delbert J. Barnard

[57] ABSTRACT

The shank portion of a bolt member is insertable through aligned openings in plural objects which are to be attached together. A first abutment is fixed to one end of the bolt shank and a removable abutment is connectable to the opposite end of the bolt shank. A pair of clasp members are pin connected to an end of an annular member in such a way that they can be moved angularly together and apart. They are formed to include jaw portions. which can engage a circumferential groove formed on the end of the bolt shank opposite the first abutment. An outer housing is connected to the inner member and is telescopically moveable into a position wherein a portion of it surrounds the two clasp members after they have been brought into engagement with the girth groove portion of the bolt shank. A key operated tumbler lock mechanism is provided for locking the housing in this position.

6 Claims, 3 Drawing Figures

BOLT TYPE LOCK

BACKGROUND OF THE INVENTION

1. Field of the Invention

My invention relates to a portable lock. More particularly, it relates to a portable lock in the nature of a bolt type fastener, but having a locked-on removeable abutment in lieu of a thread attached nut.

2. Description of the Prior Art

The following U.S. Pat. Nos. constitute the only prior art of which I am aware:

U.S. Pat. No. 3,492,318, granted Dec. 27, 1949, to Norman N. Reichert; U.S. Pat. No. 2,660,872, granted Dec. 1, 1953, to Arthur W. Beach; U.S. Pat. No. 3,995,459, granted Dec. 7, 1976, to Wilfred G. Weeks and Malcolm A Taylor; U.S. Pat. No. 4,026,132, granted May 31, 1977, to Walter E. Best; U.S. Pat. No. 4,031,720, granted June 28, 1977, Mauricio V. Avaiusini; U.S. Pat. No. 4,057,984, granted Nov. 15, 1977, to Mauricio V. Avaiusini; and U.S. Pat. No. 4,111,015, granted Sept. 5, 1978, to Robert A. Look.

The above patents can speak for themselves with respect to what they disclose, so for that reason their technical content will not herein be described. However, such patents should be carefully considered when evaluating the invention for the purpose of putting it into proper perspective relative to the prior art.

SUMMARY AND DESCRIPTION OF THE INVENTION

Generally speaking, the portable lock of this invention is in two parts. The first part is like a bolt; it comprises a shank having a first abutment at one of its ends. The opposite end of the shank is formed to include a girth groove adapted for receiving a pair of clasp members which are a part of a second abutment. According to the present invention, the second abutment comprises a pair of clasp members, pin means connecting the clasp members together for pivotal movement angularly together and apart, jaw means on the clasp members adapted for entering the girth groove and grasping the bolt shank at the location when said clasp members are swung together about the girth groove portion of the bolt shank, and a housing which is lockable into a position about the clasp members when they are together, engaging the bolt shank, so that said clasp members cannot be moved apart or be freed from the bolt shank until and unless the housing is unlocked and removed.

These and other features of the invention are described below in reference to the preferred embodiment. Also, the claims are to be taken as descriptions of additional aspects of the invention.

DESCRIPTION OF THE PREFERRED EMBODIMENT

Figure 2:
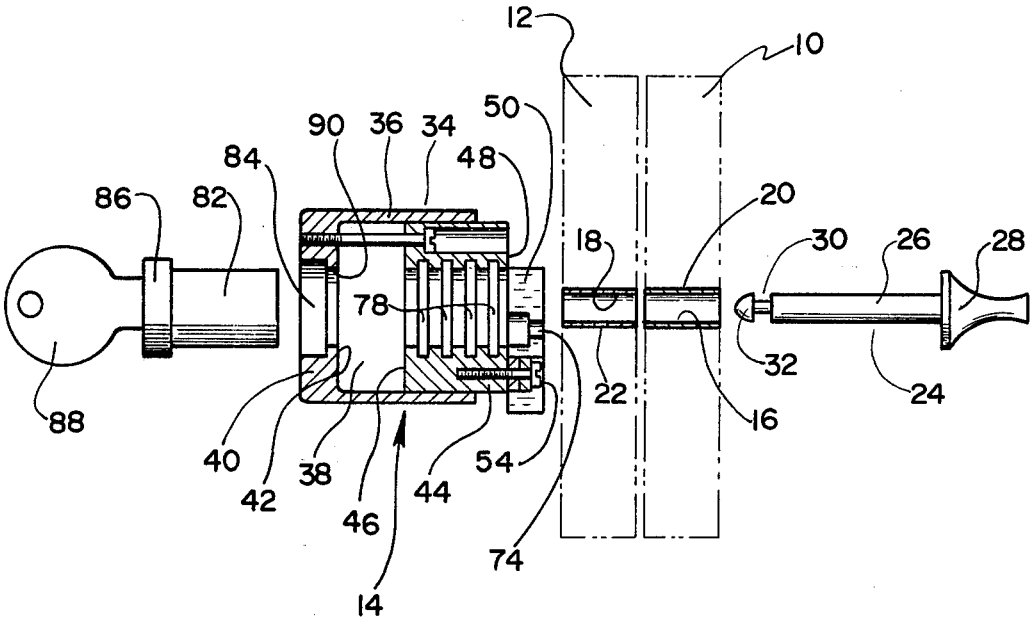
FIG. 2 is a view taken from the same aspect of FIG. 1, but showing the several parts of the lock mechanism exploded part.
Figure 1:
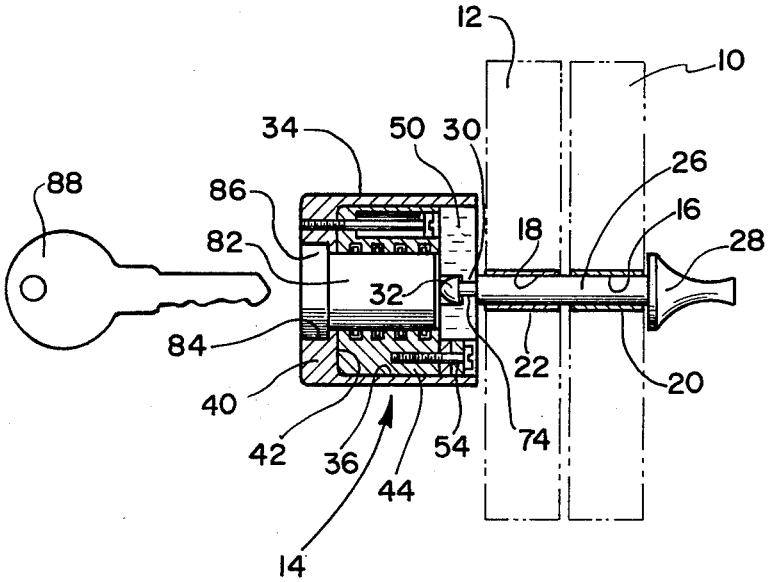
FIG. 1 is a view partially in section and partially in elevation, showing the shank portion of bolt member extending through aligned openings in a pair of skis and the removable abutment secured to a projecting girth groove portion of the bolt shank.

Referring now to FIGS. 1 and 2, fragmented upper or lower end portions of a pair of skis 10, 12 are shown positioned back-to-back and connected together by a lock mechanism 14 embodying the present invention. Holes 16, 18 are formed in the skis 10, 12 and tubular inserts or liners 20, 22 are secured within the holes 16, 18.

My aforementioned U.S. Pat. Nos. 4,031,720 and 4,057,984 illustrate a manner of locking a pair of skis onto a horizontal rail by means of upper and lower lock mechanisms attached to the skis. The lock mechanisms lock together the upper portions of the skis above the rail and the lower portions of the skis below the rail, making it impossible to remove the skis from the rail until the lock mechanisms are removed. The lock mechanism of the present invention is an alternative to the lock mechanisms which are disclosed by my aforementioned prior patents.

Lock mechanism 14 comprises a bolt member 24 having a shank 26 and a first abutment or head 26 at one end of the shank 26. The bolt shank 26 is formed to include a girth groove 30 in its end portion opposite the abutment 28. Also, the end portion 32 of shank 26 which is situated endwise outwardly from groove 30 may be bullet shaped for facilitating its entry into the sleeve-lined holes 16, 18 in the skis 10, 12.

As best shown by FIGS. 1 and 2, the bolt shank 26 is sized to be slightly smaller in diameter than the inside diameter of the sleeves 20, 22. The distance between the inboard surface of abutment 26 and the inboard boundary of girth groove 30 is slightly greater than the combined thicknesses of the skis 10, 12, so that when the skis 10, 12 are together, with the sleeve-lined openings 16, 18 therein aligned, and the bolt 24 is in place within said holes 16, 18 the girth groove 30 will be located immediately outwardly of the ski face. This arrangement is best shown by FIG. 1.

The second part of the lock mechanism 14 is a lock operated device which is attachable to the projecting girth groove portion of the bolt member 24 to prevent unauthorized removal of the bolt member 24 from the skis 10, 12. Hence, the second part of the lock mechanism 14 will be herein termed a second abutment. It can be compared to the "nut" portion of a nut-and-bolt fastener, except that it is lockable onto the end of the bolt member 24.

The second abutment 34 comprises an outer housing 36 having an inner cavity 38 which is opened at one end and which at its opposite end is partially bounded by an annular end wall 40, providing an inner shoulder 42.

An annular inner member 44 is telescopically received within the cavity 38. Member 44 includes a first end surface 46 which is directed towards the shoulder 42 and an opposite end surface 48. End surfaces 46, 48 are planer and parallel to each other.

A pair of clasp members 50, 52, each in the nature of a half-disc, are pivotally connected together by means of a bolt 54 which passes through openings in overlapping hinge portions of the members 50, 52 and threads into a threaded bore formed in the annular member 44.

When the two members 50, 52 are together they form a disc which is substantially equal in diameter to the annular inner member 44. Also, the axial dimension of the assembly composed of members 50, 52 and annular inner member 44 is substantially equal to the axial dimension of cavity 38. Thus, when such assembly is retracted within the cavity 38 and the end surface 46 is in contact with shoulder 42, the outer faces of the members 50, 52 are substantially flush with the end boundary of housing 36 at the open end of the cavity of 38.

As shown by all three figures, inner member 44 includes a pair of diametrically opposed blind bores 56, 58, sized to receive the head portions 60, 62 of a pair of retainer bolts 64, 66. Shank portions of the bolts 64, 66 extend through axial openings (e.g. 68 in the case of bore 56) formed in the floors of the bores, and thread into threaded bores 70, 72 formed in the end wall 40.

As best shown by a comparison of FIGS. 1 and 2, the head portions 60, 62 of bolts 64, 66 are spaced axially from the shoulder 42 a sufficient distance to place them closely adjacent the open ends of the bores 56, 58 when the inner assembly 44, 50, 52 is retracted. This allows a limited amount of telescopic movement of the annular member 44 out from the cavity 38 and away from the shoulder 42. The amount of telescopic movement that may occur is enough so that when additional movement is arrested by contact between the floors of the bores 56, 58 and the heads 60, 62 of the screws 64, 66, the two clasp members are positioned outside of the confines of the outer housing 36, but the inner portion of annular inner member 44 is still located within the cavity 38. As shown by FIG. 1, when the end surface 46 is against the shoulder 42 the clasp members 50, 52 are surrounded by the annular wall of the outer housing 36.

A pivot pin 54 serves to mount the clasp members 50, 52 onto the annular member 44 for angular movement together and apart. The inner edge portions of members 50, 52 form "jaws" which are shaped at 74, 76, to enter into and engage the walls of the girth groove 30.

The inside surface of annular inner member 44 is formed to include a plurality of axially spaced apart annular grooves 78. Grooves 78 are provided for receiving the tumblers 80 of a tumbler lock plug 82. End wall 40 of housing 36 includes a countersink 84 which is sized to receive a flange 86 located at the outer end of the lock plug 82. When the lock plug 82 is inserted through the central opening in end wall 40, and the flange 86 is located within the countersind, the tumblers 80 are in radial alignment with the grooves 78.

As is well known in the lock art, the lock plug 82 includes a key receiving opening into which a key 88 may be inserted for operating the tumblers 80. Removal of the key 88 causes a radial outward movement or extension of the tumblers 80. Insertion of the key 88 causes the tumblers 80 to be pulled back or retracted into the lock plug 82. In accordance with the present invention, when the lock plug 82 is in place inside of member 44 and the tumblers 80 have been extended, the tumblers 80 are situated within the grooves 78. As can be clearly seen by an inspection of FIG. 1, in such situation the lock plug 82, the outer housing 36, the annular member 44 and the clasp members 50, 52 are all locked together endwise but not rotationally.

Also, when lock plug 82 is in place inside of member 44, the shoulder 90 remains telescopically immobilized between flange 86 of lock plug 82 and the end face 46 of member 44. The interlock formed by and between the tumblers 80 and the grooves 78 in annular member 44, and the fit of the flange 86 within the countersink 84, prevents relative endwise movement of the member 44 to the right relative to the housing 36. This interlock of tumblers 80 and grooves 78, and the contact which occurs between end surface 46 and face 42 of recess 38, prevents relative endwise movement the lock plug 82 to the left, as pictured.

The interlock of tumblers 80 and the grooves 78 merely prevents relative endwise (i.e. axial) movement between member 44 and the lock plug 82, but does not prevent relative rotation. A rotative force applied to housing 36 would merely cause it to rotate in position within the groove 78. Housing 36 would either rotate relative to lock plug 82 or carry lock plug 82 with it, in which case the tumblers 80 would rotate in position within the groove 78.

When it is desired to unlock the skis 10, 12, the user merely inserts his key 88 into the key opening provided in the lock plug 82. This results in the tumblers 80 being withdrawn from the grooves 78 back into the housing of the lock plug 82. While the key is in the lock plug 82 and the tumblers 80 are retracted the lock plug 82 can be pulled out. Once the lock plug 82 is out, the outer housing 36 can be telescopically moved, exposing the clasp members 50, 52 to be manually opened. This frees the bolt member 29 to be pulled out of skis 10, 12.

The above described cooperation of the tie bolts 64, 66 and the bores 56, 58 prevents a complete removal of the housing 36 from the member 44, as shown by FIG. 2.

Figure 3:
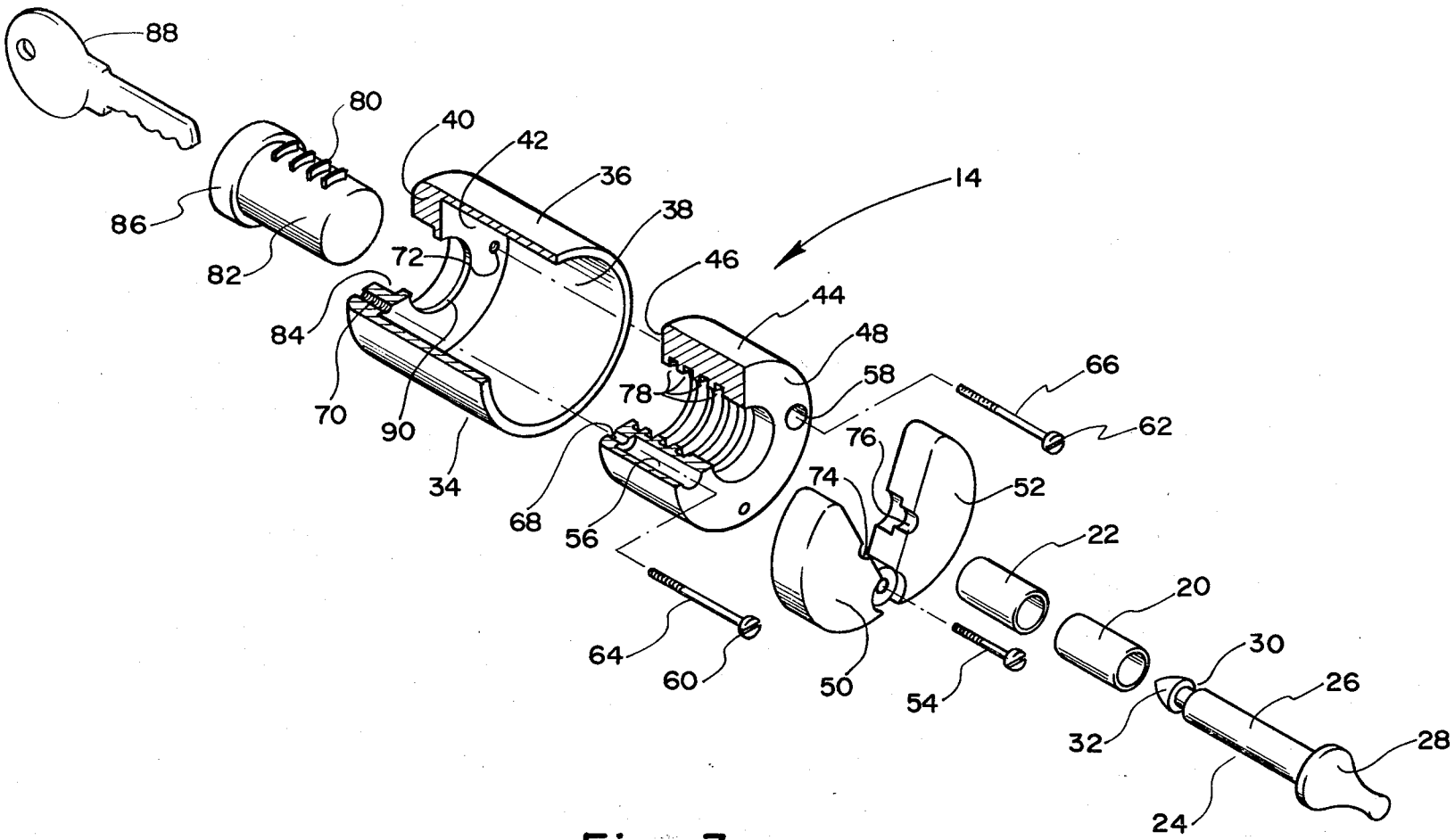
FIG. 3 is an exploded isometric view of the lock mechanism.

As can be seen by an inspection of FIGS. 2 and 3, in particular, the removal of housing 36 from a position about the clasp members 50, 52, permits the members 50, 52 to be swung apart for the purpose of disengaging the jaw regions 74, 76 of members 50, 52 from the girth groove region 30 of the bolt shank 26, and a complete removal of the second abutment 34 from the bolt 24. Then, the bolt 24 may be easily removed by the user grasping the first abutment 28, using it for a handle, and merely withdrawing the bolt 24 axially from the aligned openings 26, 18. Of course, the above described proceedure is merely reversed when it is desired to install the lock parts 24, 34 together.

Although the bolt type lock mechanism of this invention has been described as being particularly useful for connecting a pair of skis together, it is to be understood that the lock mechanism has generaly utility and can be employed for locking other types of articles together. Of course, in other installations the shape and proportions of the parts would most likely vary from what is herein illustrated, but the principles of construction and operation would remain the same.

What is claimed is:

1. A bolt type lock comprising:

a bolt member comprising an elongated shank, a first abutment at one end of the shank, and a girth groove formed in an opposite end portion of said shank; and a second abutment which is detachably connectable to the girth groove end of the shank, said second abutment comprising a pair of clasp members, pin means pivotally connecting the clasp members together for angular movement together and apart, and jaw means on said clasp members adapted for entering into said girth groove and grasping the bolt shank at the location when said clasp members are swung together about the girth groove portion of the shank, and key operated means lockable into a position about the clasp members when they are together about the girth groove portion of the bolt shank, so that said clasp members cannot be moved apart free from engagement with the bolt shank until and unless the key operated means is unlocked and removed from a position about the clasp members, said key operated means comprising an outer housing member defining an inner cavity which is open at one end and is bounded at its opposite end by an end wall, and an annular inner member within said cavity to which said clasp members are attached by means of said pin means, said annular inner member and said clasp members being telescopically received within the inner cavity of the outer housing member.

2. A bolt type lock according to claim 1, comprising movement limiting means interconnected between said annular inner member and the outer housing member, allowing telescopic movement of the clasp members and the annular inner member relatively out from the inner cavity an amount which places the clasp members entirely outside of the inner cavity, free of the confines of the outer housing member, so that the clasp members can be swung angularly apart.

3. A bolt type lock according to claim 2, wherein the movement limiting means comprises at least one axial blind bore formed in the annular inner member, said bore being open at the end of the annular inner member which is adjacent the clasp members and being closed at its opposite end but including an axial opening extending through its closed opposite end, and a tie bolt having a head portion situated within said blind bore and a shank portion which extends from the head portion through the bore and through the axial opening in the closed end of the bore and connecting to an adjacent portion of the outer housing, with the head of the tie bolt being located adjacent the open end of the bore when the outer housing member is in a position about the clasp members.

4. A bolt type lock according to claim 1, wherein the end wall of the outer housing includes a central opening and an outwardly directed countersink surrounding the central opening, wherein the inner surface of the annular inner member is formed to include a plurality of axially spaced apart circumferential grooves, and wherein said key operated means further includes a lock plug having a body sized to fit with the open center of the annular inner member, a key receiving enlarged head portion sized to fit within said countersink, and key operated, radially extendable-retractable tumblers positioned to be received within the grooves when extended but free of engagement with said grooves when retracted.

5. A bolt type lock according to claim 4, comprising movement limiting means interconnected between said annular inner member and the outer housing members allowing telescopic movement of the clasp members and the annular inner member relatively out from the inner cavity an amount which places the clasp members entirely outside of the inner cavity, free of the confines of the outer housing member, so that the clasp members can be swung angualarly apart.

6. A bolt type lock according to claim 5, wherein the movement limiting means comprises at least one axial blind bore formed in the annular inner member, said bore being open at the end of the annular inner member which is adjacent the clasp members and being closed at its opposite end but including an axial opening extending through its closed opposite end, and a tie bolt having a head portion situated within said blind bore and a shank portion situated within said blind bore and a shank portion which extends from the head portion through the bore and through the axial opening in the closed end of the bore and connecting to an adjacent portion of the outer housing, with the head of the tie bolt being located adjacent the open end of the bore when the outer housing member is in a position about the clasp members.

* * * * *